US006097913A

United States Patent [19]

Bertram et al.

[11] Patent Number: 6,097,913

[45] Date of Patent: Aug. 1, 2000

[54] TRANSFER ROLLER POSITIONING MECHANISM

[75] Inventors: Gary B. Bertram, Honeoye Falls; Gerard M. Darby, Brockport; Carol K. Dunn, Rochester; Patricia D. Reuschle, Hilton; George R. Walgrove, Rochester, all of N.Y.

[73] Assignee: Eastman Kodak Company, Rochester, N.Y.

[21] Appl. No.: 09/223,499

[22] Filed: Dec. 30, 1998

[51] Int. Cl.[7] ..... G03G 15/16

[52] U.S. Cl. ..... 399/121; 399/313

[58] Field of Search ..... 399/313, 121, 399/101, 310, 297

[56] References Cited

U.S. PATENT DOCUMENTS 5,101,238 3/1992 Creveling et al. ..... 399/101
5,491,544 2/1996 Kenin et al. ..... 399/121

*Primary Examiner*—Quana Grainger
*Attorney, Agent, or Firm*—Lawrence P. Kessler

[57] ABSTRACT

A mechanism for mounting a transfer assembly in a reproduction apparatus, the reproduction apparatus having a transfer assembly including an electrically biased transfer roller for effecting transfer of pigmented marking particle images from a dielectric member to receiver members. The transfer assembly mounting mechanism includes a tie bar weldment for supporting the transfer assembly within the reproduction apparatus. A bracket, coupled to the transfer assembly, connects the tie bar weldment to the transfer assembly such that the transfer roller of the transfer assembly is castered and gimbaled.

8 Claims, 5 Drawing Sheets

FIG. 1
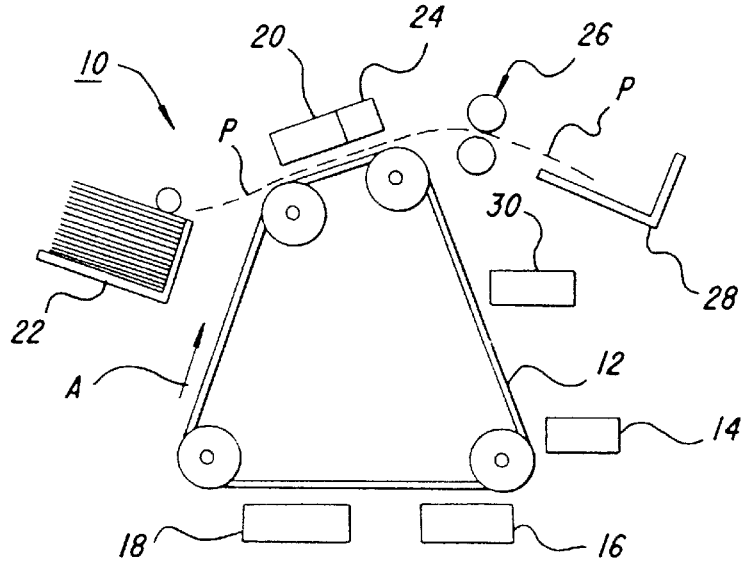
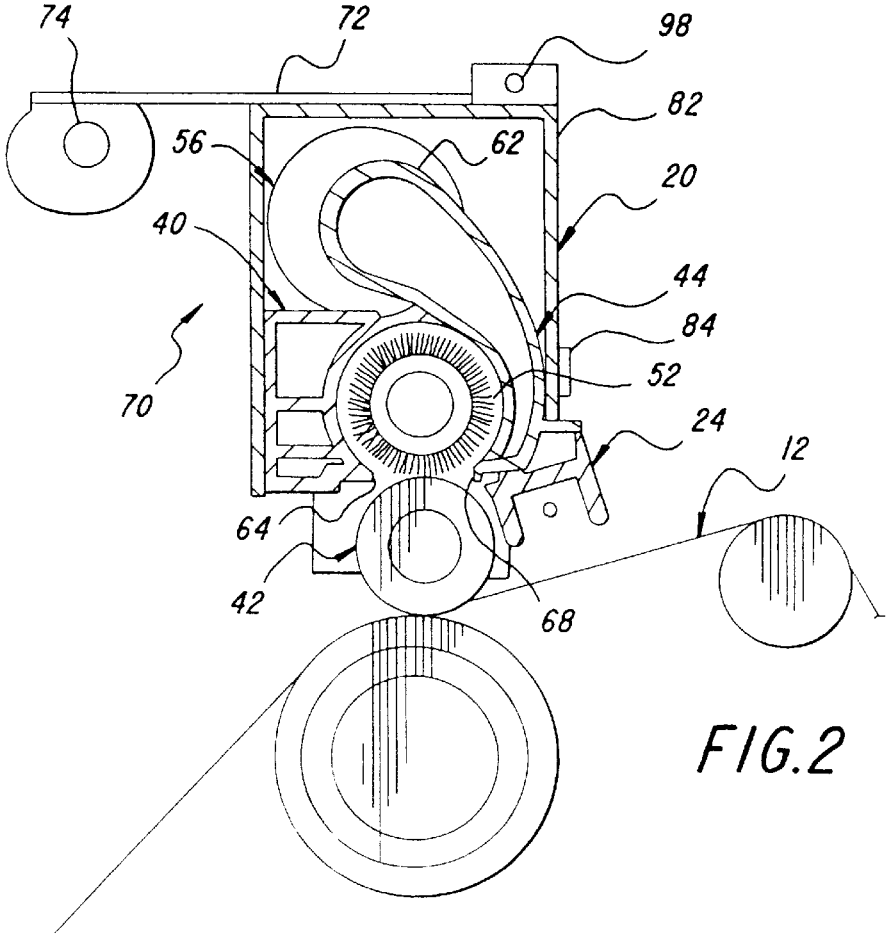
FIG. 2

TRANSFER ROLLER POSITIONING MECHANISM

BACKGROUND OF THE INVENTION

This invention relates in general to a transfer assembly for use for example in a reproduction apparatus, and more specifically to a mounting mechanism for a roller transfer assembly accurately positioning the roller transfer assembly in operative relation with a dielectric member of a reproduction apparatus.

In reproduction apparatus, such as copier/duplicators or printers, a latent image charge pattern is formed on a uniformly charged dielectric member. Pigmented marking particles are attracted to the latent image charge pattern to develop such image on the dielectric member. The dielectric member is then brought into contact with a receiver member, and an electric field is applied to transfer the marking particle developed image to the receiver member from the dielectric member. After transfer, the receiver member bearing the transferred image is transported away from the dielectric member and the image is fixed to the receiver member by heat and/or pressure to form a permanent reproduction thereon.

Application of the electric field to effect marking particle transfer is generally accomplished by ion emission from a corona charger onto the receiver member while in contact with the dielectric member, or by an electrically biased roller urging the receiver member against the dielectric member. Roller transfer apparatus offer certain advantages over corona transfer apparatus in that the roller transfer apparatus substantially eliminate defects in the transferred image due to paper cockle or marking particle flakes. This result stems from the fact that the pressure of the roller urging the receiver member against the dielectric member is remarkably efficient in providing intimate uniform contact therebetween. However, roller transfer apparatus are more complex than corona transfer apparatus in that they require cleaning due to their tendency to pick up marking particles from the dielectric member and undesirably deposit such particles on the back side of the receiver member. Further, the roller transfer apparatus, including the cleaning assemblies must be constructed so as not to interfere with ready clearance of any jammed receiver members. An example of a selectively positionable roller transfer apparatus constructed to include a cleaning mechanism is shown in U.S. Pat. No. 5,101,238 (issued Mar. 31, 1992, in the names of Creveling, et al).

While roller transfer apparatus are generally effective in carrying out desired marking particle image transfer, they tends to impose undesirable tracking effects on the dielectric member, particularly when the dielectric member is in the form of an elongated web. U.S. Pat. No. 5,491,544 (issued Feb. 13, 1996, in the names of Kenin et al) shows a transfer assembly, of compact configuration, for a reproduction apparatus. The transfer assembly includes a transfer roller for effecting transfer of a pigmented marking particle image from an elongated web dielectric member to a receiver member. A mechanism for mounting the roller transfer assembly includes a support for the transfer assembly connected to the transfer assembly such that the transfer roller of the transfer assembly is castered and gimbaled. However, this mechanism relies on the weight of the transfer assembly to establish the proper engagement with an unsupported span of the dielectric member. Since the weight of the transfer assembly cannot be controlled within tight enough tolerance limits, the described mechanism does not position the transfer roller with sufficient accuracy.

SUMMARY OF THE INVENTION

This invention is directed to a mechanism for mounting a transfer assembly in a reproduction apparatus, the reproduction apparatus having a transfer assembly including an electrically biased transfer roller for effecting transfer of pigmented marking particle images from a dielectric member to receiver members. The transfer assembly mounting mechanism includes a tie bar weldment for supporting the transfer assembly within the reproduction apparatus. A bracket, coupled to the transfer assembly, connects the tie bar weldment to the transfer assembly such that the transfer roller of the transfer assembly is castered and gimbaled.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is a schematic illustration of a typical reproduction apparatus suitable for utilizing the roller transfer assembly positioning mechanism according to this invention;

FIG. 2 is a front elevational view, partly in cross-section, of a roller transfer assembly including the positioning mechanism according to this invention;

DESCRIPTION OF THE PREFERRED EMBODIMENT

Figure 3:
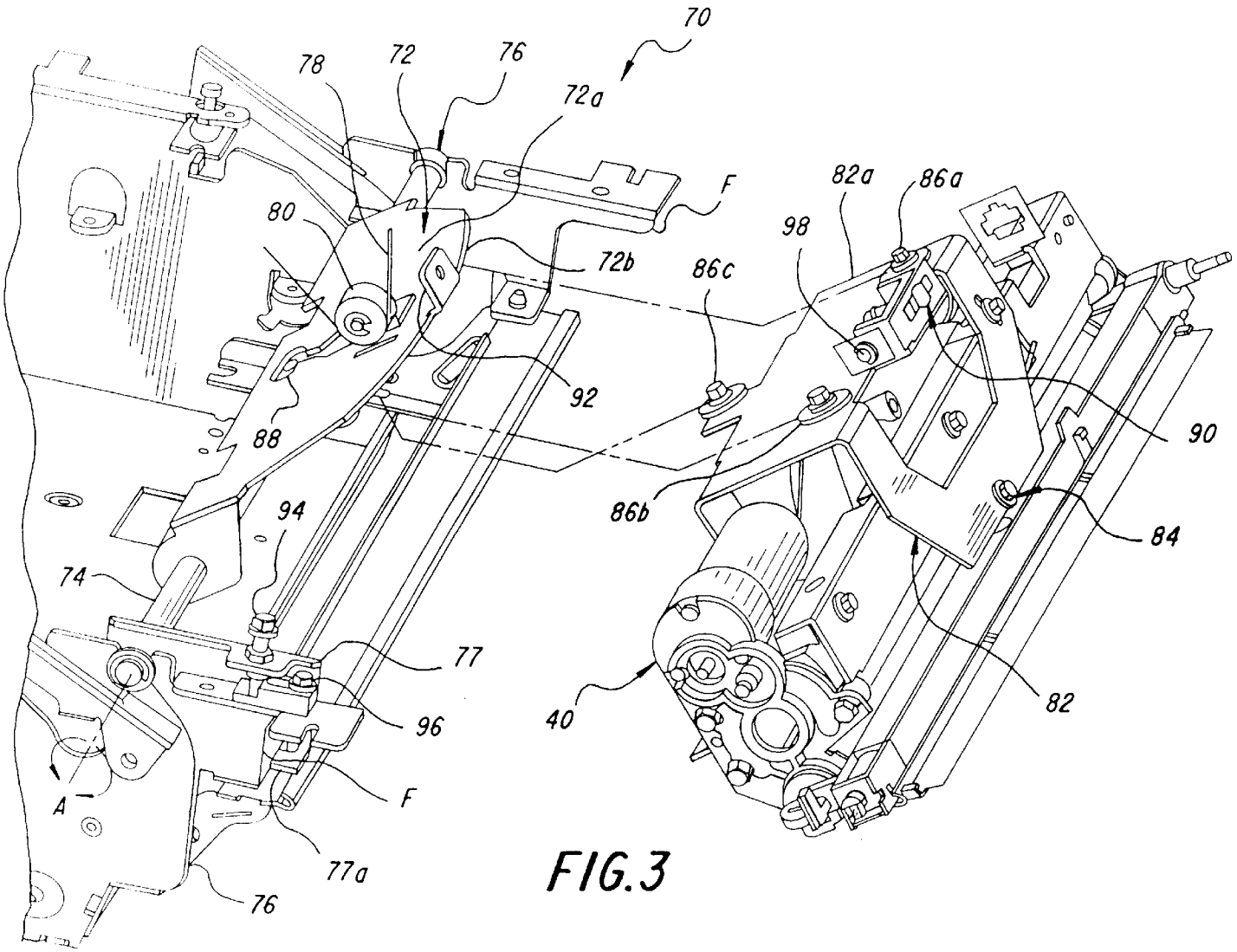
FIG. 3 is an exploded view, in perspective, of the roller transfer assembly including the transfer roller positioning mechanism of FIG. 2, with portions removed to facilitate viewing.

Referring now to the accompanying drawings, FIG. 1 schematically illustrates a typical reproduction apparatus 10, of the electrostatographic type, suitable for utilizing an exemplary roller transfer assembly such as shown and described in aforementioned U.S. Pat. No. 5,491,544. The reproduction apparatus 10, described herein only to the extent necessary for a complete understanding of this invention, includes a dielectric member 12. The dielectric member 12 is, for example, in the form of an elongated endless web mounted on support rollers and movable about a closed loop path in the direction of arrow A through a series of electrographic process stations.

In the reproduction cycle for the reproduction apparatus 10, the moving dielectric member 12 is uniformly charged as it moves past a charging station 14. Thereafter the uniformly charged dielectric member passes through an exposure station 16 where the uniform charge is altered to form a latent image charge pattern corresponding to information desired to be reproduced. Depending upon the characteristics of the dielectric member and the overall reproduction system, formation of the latent image charge pattern may be accomplished by exposing the dielectric member to a reflected light image of an original document to be reproduced or "writing" on the dielectric member with a series of lamps (e.g., LED's or lasers) or point electrodes activated by electronically generated signals based on the desired information to be reproduced. The latent image charge pattern on the dielectric member 12 is then brought into association with a development station 18 which applies pigmented marking particles to adhere to the dielectric member to develop the latent image. The portion of the dielectric member carrying the developed image then passes through a transfer station 20 in register with a receiver member fed in proper timed relation from a supply hopper 22 along the path P. An electric field produced in the transfer station attracts the marking particle of the developed image from the dielectric member to the receiver member.

The electric transfer field may also cause the receiver member to adhere to the dielectric member. Accordingly, a detack mechanism 24, immediately downstream in the direction of travel of the dielectric member, is provided to facilitate removal of the receiver member from the dielectric member. The detack mechanism may be, for example, an AC corona charger for neutralizing the attractive field holding the receiver member to the dielectric member. After the developed image is transferred to the receiver member and the receiver member is separated from the dielectric member, the receiver member is transported through a fusing device 26 where the image is fixed to the receiver member by heat and/or pressure for example, and delivered to an output hopper 28 for operator retrieval. Simultaneously, the dielectric member 12 is cleaned of any residual marking particles at cleaning station 30 and returned to the charging station 14 for reuse.

Turning now to the exemplary transfer station 20, as noted above such station is for example a roller transfer assembly which is described hereinbelow with particular reference to FIG. 2 in sufficient detail for a complete understanding of this invention. Of course, other roller transfer assemblies are suitable for use with this invention. The roller transfer assembly includes a unitary housing 40 containing a transfer roller 42, a roller cleaning mechanism 44, and a detack mechanism 24 in a compact configuration. An electrical bias is applied to the core of the roller 42 from a voltage limited constant current power supply (not shown). As such, when the transfer roller is in operative association with the dielectric member 12 (as shown in FIG. 2), an electrical transfer field is established which will efficiently transfer a marking particle developed image from the dielectric member to a receiver member passing therebetween.

When the transfer roller 42 contacts the dielectric member 12 with no receiver member therebetween, the transfer roller tends to pick up residual marking particles from the dielectric member. On subsequent passes of receiver members to accomplish developed image transfer, the marking particles on the transfer roller 42 can be deposited on the back side of the receiver members to form undesirable marks thereon. Accordingly, the transfer roller 42 must be efficiently continuously cleaned. The cleaning mechanism 44 of the roller transfer assembly 20 includes an elongated, cylindrical, fiber brush 52. The brush 52 is supported in the unitary housing 40 such that the longitudinal axis of the brush is parallel to the longitudinal axis of the transfer roller 42. The respective longitudinal axes are spaced apart a distance such that a portion of the peripheral surface of the brush 52 contacts the transfer roller 42. A motor 56, attached to the unitary housing 40, is coupled to the brush 52 to rotate the brush at a high rate of speed and preferably in a direction such that, in the area of contact between the brush and the transfer roller, the two are moving in opposite directions to effectively sweep marking particles (and any accumulated paper dust) from the transfer roller into the fibers of the brush.

In order to keep the fibers of the brush 52 from becoming overloaded with marking particles cleaned from the transfer roller 42, the cleaning mechanism 44 also includes a vacuum air flow system 62. The vacuum air flow system 62, in flow communication with a vacuum blower (not shown), forms an air flow directing chamber about the brush 52. The air flow chamber provides an air flow passage wrapping about a portion of the brush 52 with an opening 64 to the brush located adjacent to the peripheral surface of the brush downstream (in the direction of rotation of the brush) from the area of contact between the brush and the transfer roller and extending in the direction of the longitudinal axis of the brush. A lip 68 extends into the fibers of the brush. As the brush 52 is rotated by the motor 56, the lip 68 acts as a flicker bar to bend the brush fibers and snap the fibers to facilitate release of particulate material therefrom. Such freed particulate material is entrapped in the air flow stream and transported away from the cleaning mechanism to a remote collection location (not shown).

The detack mechanism 24 of the roller transfer assembly is preferably an AC corona charger interconnected with the unitary housing 40. The detack mechanism 24 is located such that when the roller transfer assembly 20 is in operative association with the dielectric member 12, the detack charger is located downstream (in the direction of dielectric member travel) from the transfer roller 42 to effectively provide a field which relieves the electrostatic attraction forces between the receiver member and the dielectric member. In this manner, the receiver member is readily detacked from the dielectric member for transport along its intended path P to the fusing device 26 (FIG. 1 ) without interference or jamming.

Figure 4:
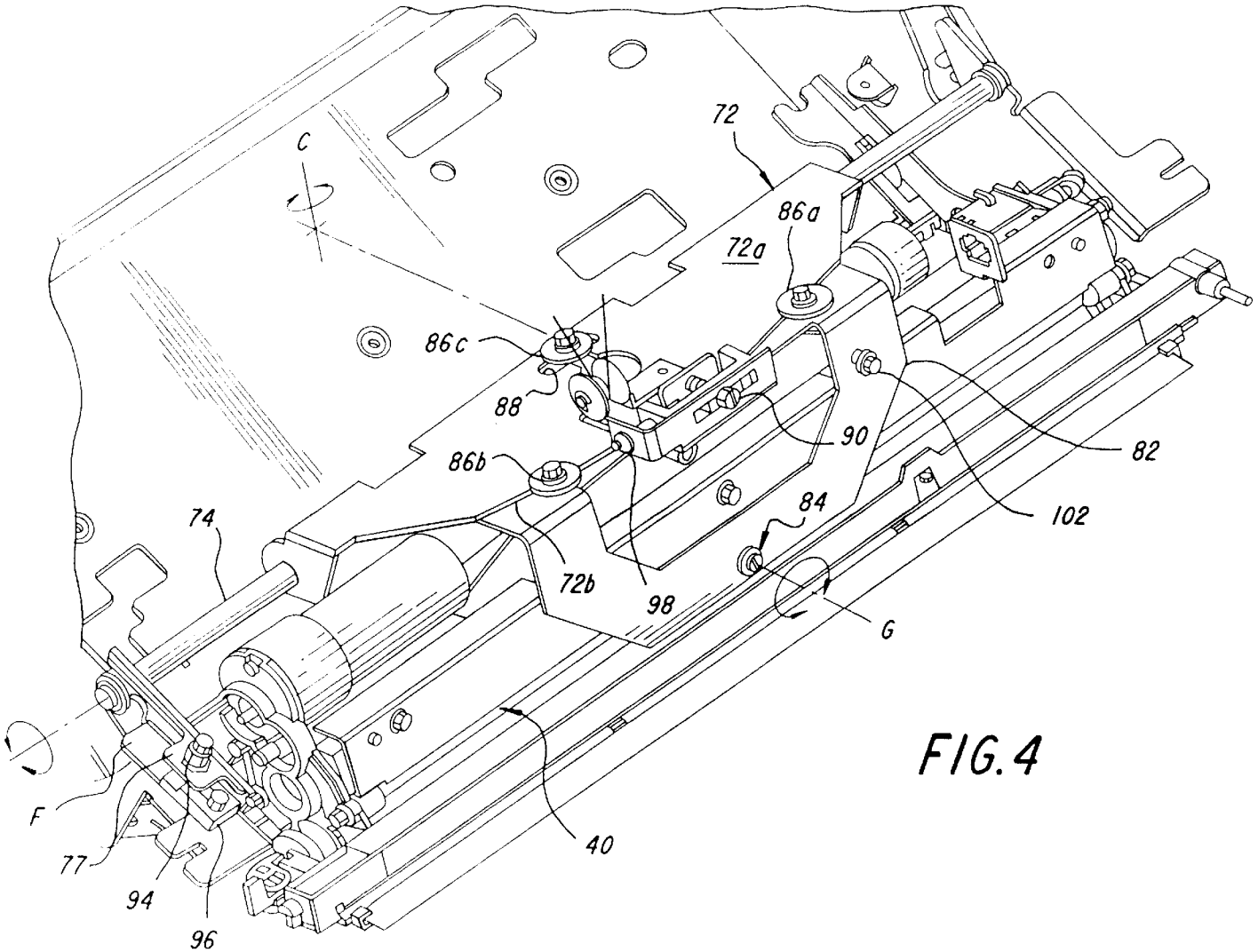
FIG. 4 is a view, in perspective, of the roller transfer assembly including the transfer roller positioning mechanism of FIG. 2, with portions removed to facilitate viewing.

With the compact arrangement for the roller transfer assembly described above, a mounting, designated generally by the numeral 70, is provided according to this invention. The mounting 70 enables the roller transfer assembly to contact the dielectric member 12 in a manner so as to impart no steering forces to the moving support. Accordingly, as best shown in FIGS. 2–4, the mounting 70 for the roller transfer assembly includes a tie bar weldment 72 permanently mounted in the machine frame F of the reproduction apparatus 10. The tie bar weldment 72 includes a plate member 72*a* fixed to a shaft 74. The shaft, in turn, rests in bushings 76 on the machine frame F. As such, the tie bar weldment 72 is free to rotate about the longitudinal axis of the shaft 74. A cable assembly 78 is attached to a pulley 80 mounted on the tie bar weldment plate member 72*a*. The cable assembly 78 serves to urge the tie bar weldment plate member 72*a* for rotation about the axis of the shaft 74 (in a substantially clockwise direction in FIG. 3) when components (not shown) in the receiver member travel path are lifted, for example for the purpose of jam clearance.

The unitary housing 40 of the roller transfer assembly has a substantially U-shaped bracket 82 fixed to the housing by a pivot assembly 84, more fully described below. The base member 82*a* of the bracket 82 supports three flanged bushings 86*a*, 86*b*, and 86*c*. When the bracket 82 is assembled with the tie bar weldment 72, the flanged bushings 86*a* and 86*b* ride against a curved lead edge 72*b* of the tie bar weldment plate member 72*a*, while bushing 86*c* is received through a keyhole slot 88 defined in the plate member. A captive spring loaded locking screw 90 secures the bracket 82, and thus the roller transfer assembly housing 40, to an upstanding tab 92 of the tie bar weldment plate member 72*a*.

Figure 5:
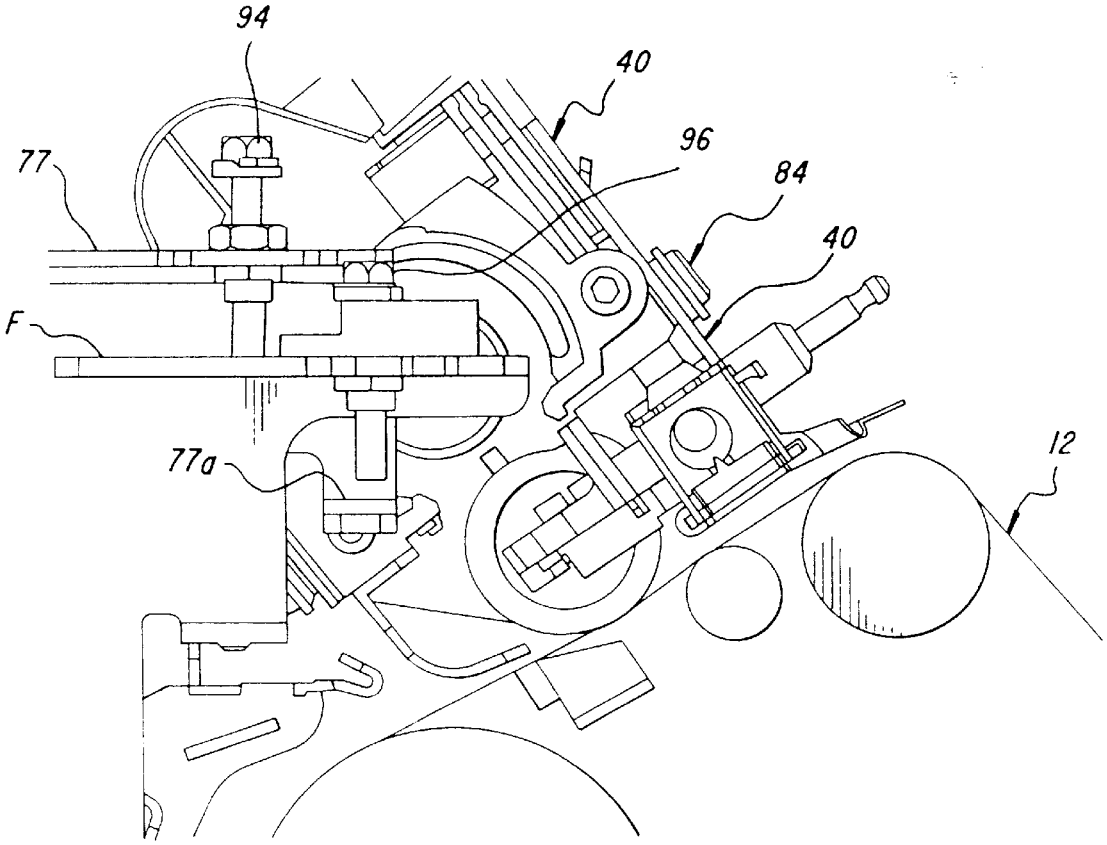
FIG. 5 is a front elevational view, partly in cross-section and on an enlarged scale, of a portion of the roller transfer assembly including the rotational adjustment for the positioning mechanism according to this invention.

Two adjusting screws 94 and 96 are provided to establish the limits of rotation of the tie bar weldment plate member 72*a* about the longitudinal axis of the shaft 74. An arm 77 is fixed to the shaft 74 for rotation therewith, and extends substantially radially therefrom. The adjusting screw 94, as best shown in FIG. 5, extends through the arm 77 a predetermined adjustable distance. As such, the limiting end of the screw 94 is engagable with a portion of the frame F of the reproduction apparatus to limit rotation in one direction (in the clockwise direction of FIG. 3) for the tie bar weldment plate member 72*a*. The limit position for the plate member is predetermined so as to set the engagement of the transfer roller 42 with the dielectric member 12 in order to establish proper operative relation therebetween.

The adjusting screw 94, as also best shown in FIG. 5, extends through the portion of the frame F, adjacent to the point of contact of the screw 94, a predetermined adjustable distance. As such, the limiting end of the screw 94 is engagable with a portion 77*a* extending from the arm 77 to limit rotation in the opposite direction (in the clockwise direction of FIG. 3) for the tie bar weldment plate member 72*a*. The limit position for the plate member is predetermined so as to set the disengagement of the transfer roller 42 from the dielectric member 12 in order to establish sufficient clearance available between the roller transfer assembly and the dielectric member 12 for clearing a receiver member jam. After lifting the tie bar weldment plate member 72*a* (and the attached roller transfer assembly) for clearing a jam or replacing the roller transfer assembly after servicing, the weight of the roller transfer assembly, bracket 82 and tie bar weldment 72 is sufficient to assure that the adjusting screw 94 returns into engagement with the frame F so that the transfer roller 42 properly reengages the dielectric member 12 in operative relation therewith.

Figure 6:
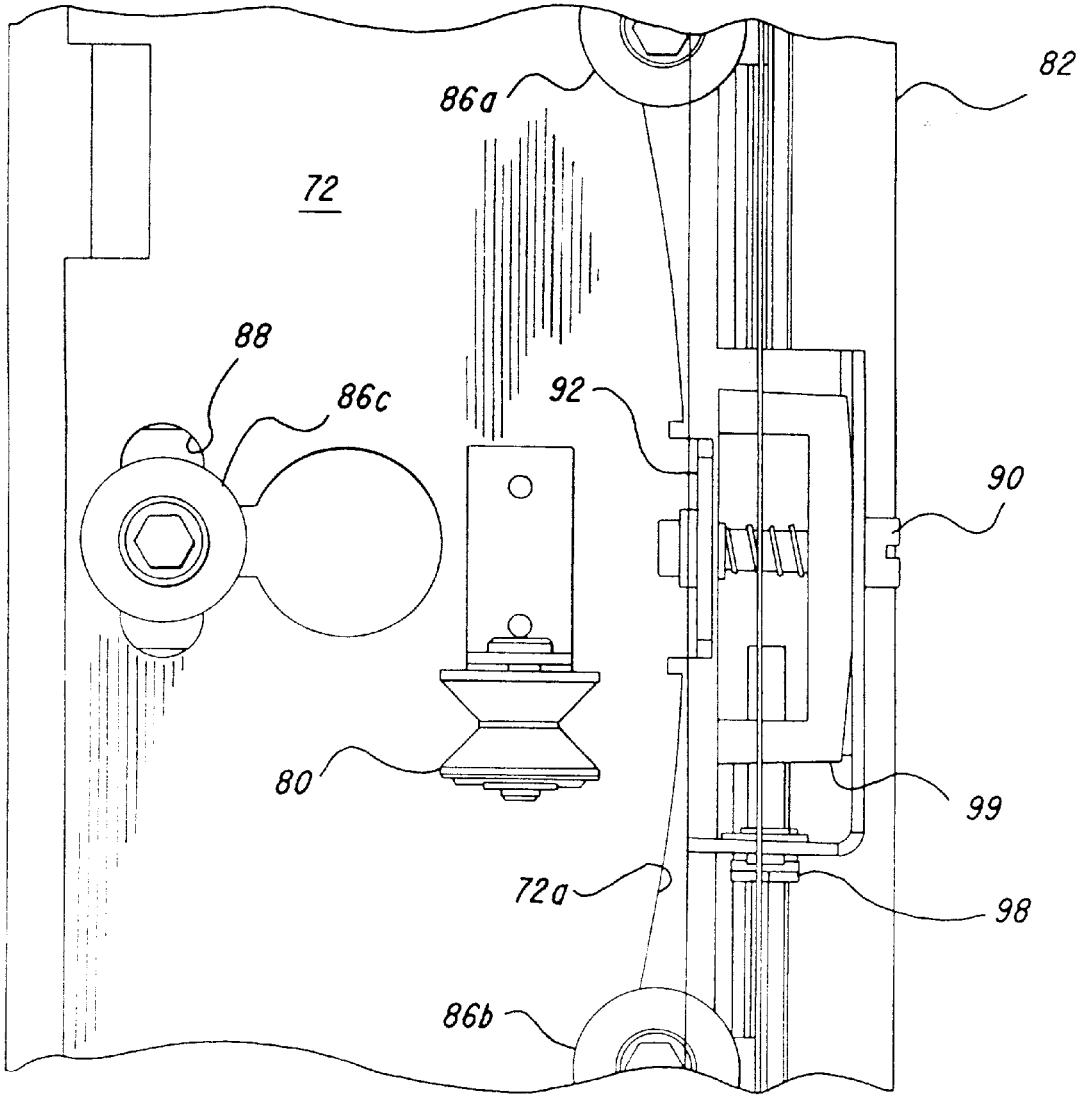
FIG. 6 is a top plan view, with portions removed, of a roller transfer assembly including the caster axis rotational adjustment for the positioning mechanism according to this invention;.

In order that the transfer roller 42 properly tracks with the dielectric member 12, the roller transfer assembly housing 40 is enabled by the mechanism 70 to caster about a caster axis C (see FIG. 4). As seen in FIG. 6, a lead screw 98 selectively moves an adjusting block 99 attached to the bracket 82. The movement of the adjusting block 99 by the adjusting lead screw 98 causes the flanged bushings 86*a*, 86*b* on the bracket 82 to follow the curved surface 72*b* of the tie bar weldment 72. The curved surface 72*b* is selected to have a radius of curvature substantially equal to the distance between the curved surface and the caster axis C. As such, the bracket 82 will properly rotate about the caster axis C. When the bracket 82 is properly located about the caster axis C relative to the tie bar weldment 72, the captive locking screw 90 may be tightened to maintain the bracket and weldment in the desired relative position. Locking out the caster motion insures that external forces, for example from attached air hoses and electrical cables (not shown) do not influence the position of the transfer roller 42 to compromise dielectric member tracking. Of course, according to this invention, active castering could be provided during the running of a reproduction job.

The roller transfer assembly, in the bracket 82, is also enabled to rotate about the gimbal axis G (see FIG. 4). A pivot pin assembly 84 carried by the bracket 82, and connected to the roller transfer assembly housing 40. The longitudinal axis of the pivot pin assembly is coincident with the gimbal axis G. As such, the roller transfer assembly housing 40 is rotatable, in the bracket 82, about the pivot pin assembly 84, and thus about the gimbal axis G. When the roller transfer assembly housing 40 is properly located about the gimbal axis G relative to the bracket 82, a locking screw 102 may be tightened to maintain the housing and the bracket in the desired relative position.

The castering and gimbaling of the transfer roller 42 substantially eliminate unwanted reaction forces on the dielectric member 12 by the transfer roller which would result from otherwise over constraining the movement of the transfer roller. Accordingly, the quality of the reproductions will be both better and more consistent in that they will have less artifacts. Furthermore, there will be less wear on the dielectric member so as to improve its life, and the dielectric member will be less subject to crashes due to improper steering effects otherwise induced by the transfer roller.

The invention has been described in detail with particular reference to preferred embodiment thereof, but it will be understood that variations and modifications can be effected within the spirit and scope of the invention.

What is claimed is:

1. In a reproduction apparatus having a transfer assembly, including an electrically biased transfer roller for effecting transfer of pigmented marking particle images from a dielectric member to receiver members, a mechanism for mounting said transfer assembly in said reproduction apparatus, said mechanism comprising:

a tie bar weldment for supporting said transfer assembly within said reproduction apparatus, said tie bar weldment including a shaft and a plate, said plate being mounted on said shaft for rotation about the longitudinal axis of said shaft; and a bracket, coupled to said transfer assembly, said bracket including a plurality of bushings, said plate of said tie bar weldment having a curved lead edge engageable by said bushings of said bracket for enabling adjustable movement of said bracket relative to said tie bar weldment about a caster axis, and a pivot pin assembly, coincident with a gimbal axis, engageable with said transfer assembly to enable said transfer assembly to rotate relative to said bracket about said gimbal axis.

2. The mechanism for mounting said transfer assembly of claim 1 including a first member adjustably limiting rotation of said plate about said shaft in a first direction for setting an operational relation between said transfer roller and said dielectric member, and a second member adjustably limiting rotation of said plate about said shaft in a second direction, opposite said first direction, for setting a non-operational relation between said transfer roller and said dielectric member.

3. The mechanism for mounting said transfer assembly of claim 2 wherein said first and second members are independent adjusting screws.

4. The mechanism for mounting said transfer assembly of claim 1 wherein said curved lead edge of said plate has a radius of curvature substantially equal to the distance of said curved lead edge from said caster axis.

5. In a reproduction apparatus having a transfer assembly for effecting transfer of pigmented marking particle images from a dielectric member to receiver members, said transfer assembly comprising:

an electrically biased transfer roller;

a mechanism for cleaning said transfer roller;

a housing for containing said transfer roller and said transfer roller cleaning mechanism; and a mechanism for mounting said housing for movement relative to said dielectric member about a caster axis and about a gimbal axis, said mounting mechanism including a tie bar weldment, said tie bar weldment including a shaft and a plate, said plate being mounted on said shaft for rotation about the longitudinal axis of said shaft, and a bracket, said bracket including a plurality of bushings, said plate having a curved lead edge engagable by said bushings of said bracket for enabling adjustable movement of said bracket relative to said tie bar weldment about the caster axis, and a pivot pin assembly, coincident with the gimbal axis, engageable with said transfer assembly to enable said transfer assembly to rotate relative to said bracket about said gimbal axis.

6. The transfer assembly of claim 5 including a first member adjustably limiting rotation of said plate about said shaft in a first direction for setting an operational relation between said transfer roller and said dielectric member, and a second member adjustably limiting rotation of said plate about said shaft in a second direction, opposite said first direction, for setting a non-operational relation between said transfer roller and said dielectric member.

7. The transfer assembly of claim 6 wherein said first and second members are independent adjusting screws.

8. The transfer assembly of claim 5 wherein said curved lead edge of said plate has a radius of curvature substantially equal to the distance of said curved lead edge from said caster axis.

* * * * *